US011286818B2

(12) United States Patent
McCarthy, Jr. et al.

(10) Patent No.: US 11,286,818 B2
(45) Date of Patent: Mar. 29, 2022

(54) MODULAR ROCKER ARM

(71) Applicant: Eaton Intelligent Power Limited, Dublin (IE)

(72) Inventors: James E. McCarthy, Jr., Kalamazoo, MI (US); Mark Van Wingerden, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/099,720

(22) PCT Filed: May 10, 2017

(86) PCT No.: PCT/US2017/032039
§ 371 (c)(1),
(2) Date: Nov. 8, 2018

(87) PCT Pub. No.: WO2017/197044
PCT Pub. Date: Nov. 16, 2017

(65) Prior Publication Data

US 2019/0178113 A1 Jun. 13, 2019

Related U.S. Application Data

(60) Provisional application No. 62/334,042, filed on May 10, 2016.

(51) Int. Cl.
*F01L 1/18* (2006.01)
*F01L 13/06* (2006.01)
(Continued)

(52) U.S. Cl.
CPC ..... *F01L 1/181* (2013.01); *F01L 1/18* (2013.01); *F01L 1/20* (2013.01); *F01L 1/24* (2013.01);
(Continued)

(58) Field of Classification Search
CPC . F01L 1/181; F01L 1/2416; F01L 1/18; F01L 1/20; F01L 1/24; F01L 1/2411;
(Continued)

(56) References Cited

U.S. PATENT DOCUMENTS 6,314,928 B1 * 11/2001 Baraszu ..... F01L 13/0005 123/90.16
7,600,496 B2 * 10/2009 Nakamura ..... F01L 13/0026 123/90.16
(Continued)

FOREIGN PATENT DOCUMENTS

CN 101012761 A 8/2007
CN 105089732 B 12/2017
(Continued)

OTHER PUBLICATIONS

International Search Report and Written Opinion dated Aug. 23, 2017 for PCT/US2017/032039; pp. 1-15.

*Primary Examiner* — Devon C Kramer
*Assistant Examiner* — Kelsey L Stanek
(74) *Attorney, Agent, or Firm* — Mei & Mark, LLP

(57) ABSTRACT

A modular exhaust valve rocker arm assembly system comprising first and second rocker arm assemblies configured to each selectively receive a hydraulic lash adjustment assembly or a mechanical lash adjustment assembly. A main lifter assembly operably associated with the first and second rocker arm assemblies. An added motion lifter assembly operably associated with the first rocker arm assembly and configured to selectively provide one of an early lift profile and an extended lift profile, which can comprise at least one of an engine braking feature, a late intake valve closing (LIVC) feature, and an early exhaust valve opening (EEVO) feature. The main lifter can be configured as a fixed lifter or as a deactivating lifter for cylinder deactivation (CDA)
(Continued)

configured to selectively move to a deactivated state configured to absorb motion of a normal lift profile cam into lost motion.

14 Claims, 9 Drawing Sheets

(51) Int. Cl.
*F01L 1/24* (2006.01)
*F01L 1/20* (2006.01)
*F01L 13/00* (2006.01)

(52) U.S. Cl.
CPC ..... *F01L 1/2411* (2013.01); *F01L 1/2416* (2013.01); *F01L 13/0005* (2013.01); *F01L 13/06* (2013.01); *F01L 13/065* (2013.01); *F01L 2001/186* (2013.01)

(58) Field of Classification Search
CPC ..... F01L 13/0005; F01L 13/06; F01L 13/065; F01L 2001/186
USPC ..... 123/90.12, 90.39, 90.44, 90.16
See application file for complete search history.

(56) References Cited

U.S. PATENT DOCUMENTS

| | | | | |
|---|---|---|---|---|
| 7,685,980 | B2 | 3/2010 | Lee et al. | |
| 8,667,936 | B2 * | 3/2014 | Kajiura | F01L 13/0021 123/90.16 |
| 8,789,502 | B2 | 7/2014 | Barnes | |
| 8,936,006 | B2 | 1/2015 | Groth et al. | |
| 9,464,541 | B2 | 10/2016 | Haga | |
| 2004/0123825 | A1 | 7/2004 | Nagano et al. | |
| 2008/0078345 | A1 | 4/2008 | Knauf et al. | |
| 2008/0078346 | A1 * | 4/2008 | Lee | F01L 13/0047 123/90.17 |
| 2012/0024260 | A1 | 2/2012 | Groth et al. | |
| 2012/0210964 | A1 | 8/2012 | Barnes | |
| 2014/0245992 | A1 * | 9/2014 | Groth | F01L 13/065 123/321 |
| 2014/0251266 | A1 * | 9/2014 | Emmons | F01L 13/065 123/321 |
| 2014/0326212 | A1 | 11/2014 | Baltrucki et al. | |
| 2015/0330265 | A1 | 11/2015 | Haga | |

FOREIGN PATENT DOCUMENTS

| | | | |
|---|---|---|---|
| JP | 2009264200 | A | 11/2009 |
| WO | 0020730 | A1 | 4/2000 |

* cited by examiner

MODULAR ROCKER ARM

This is a § 371 National Stage Entry of Application No. PCT/US2017/032039, filed May 10, 2017 and claims the benefit of U.S. Provisional Application No. 62/334,042, filed May 10, 2018, all of which are incorporated herein by reference.

FIELD

This application provides a rocker arm assembly for an engine valvetrain that is modularly configured.

BACKGROUND

Some valve train assemblies include compression engine braking as a primary function. Compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly. However, such typical systems only provide preset features and functions that cannot be changed without significant cost or complete replacement. Accordingly, it is desirable to provide an improved rocker arm assembly.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

The methods and devices disclosed herein overcome the above disadvantages and improves the art by way of a modular exhaust valve rocker arm assembly system comprising first and second rocker arm assemblies configured to each selectively receive a hydraulic lash adjustment assembly or a mechanical lash adjustment assembly. A main lifter assembly operably associated with the first and second rocker arm assemblies. An added motion lifter assembly operably associated with the second assembly and configured to selectively provide one of an early lift profile and an extended lift profile, which can comprise at least one of an engine braking feature, a late intake valve closing (LIVC) feature, and an early exhaust valve opening (EEVO) feature. The main lifter can be configured as a fixed lifter or as a deactivating lifter for cylinder deactivation (CDA) configured to selectively move to a deactivated state configured to absorb motion of a normal lift profile cam into lost motion.

In addition to the foregoing, the exhaust valve rocker arm assembly may include one or more of the following features: wherein the added motion lifter assembly includes an actuator assembly configured to move between a retracted position and an extended position.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1A:
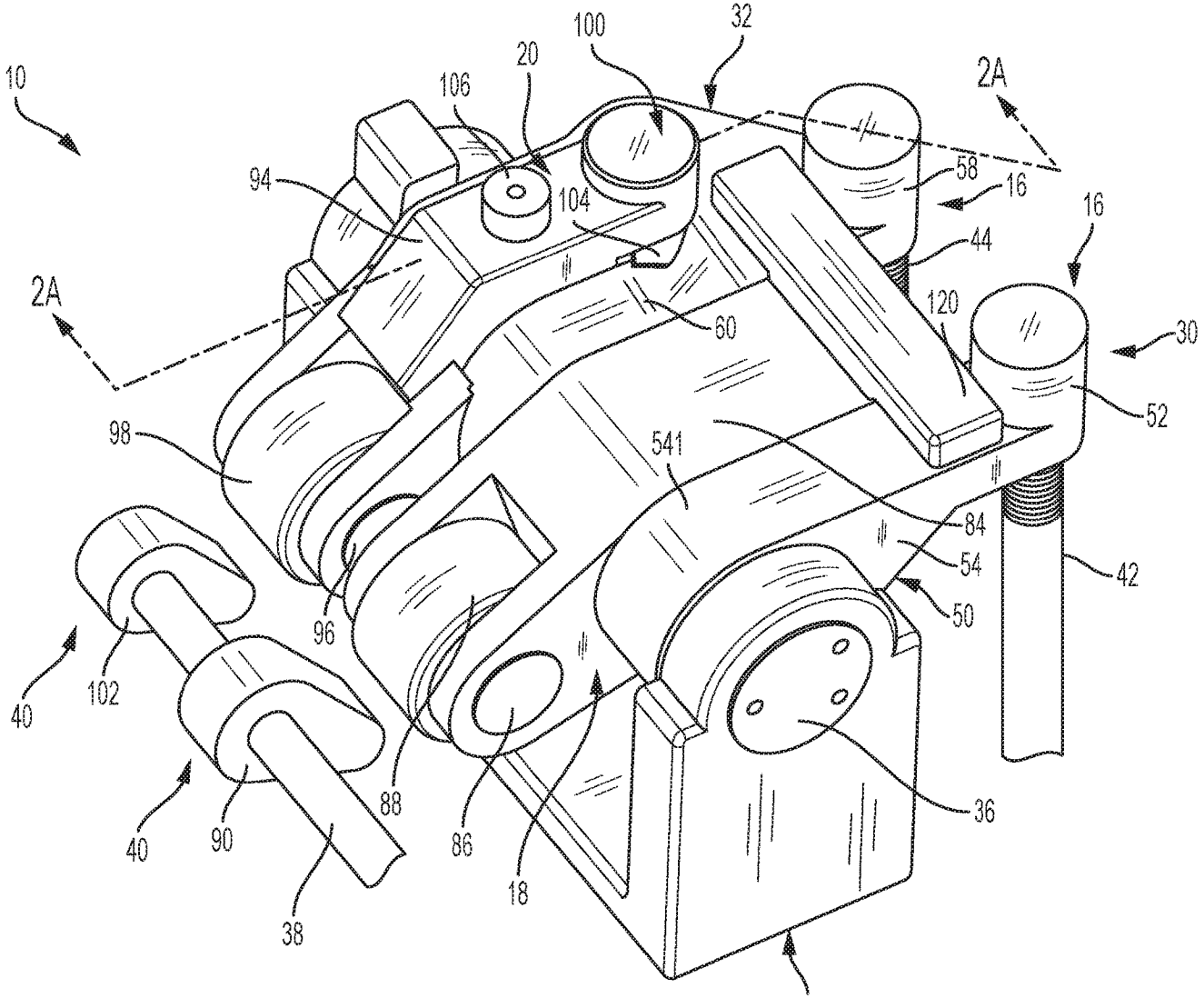
FIGS. 1A & 1B are views of a portion of a modular valvetrain assembly.
Figure 1B:
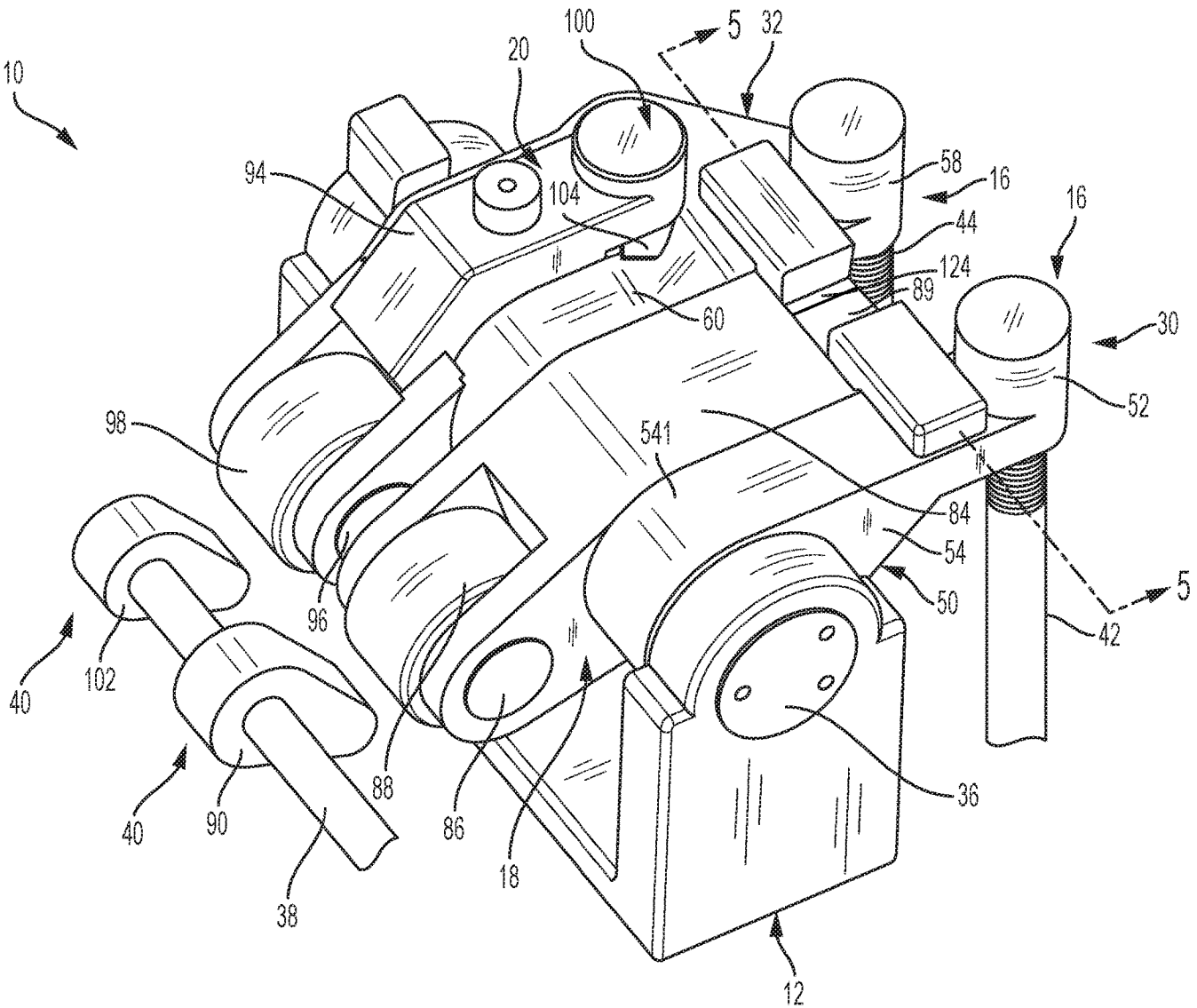

With initial reference to FIGS. 1A & 1B, partial modular valve train assemblies 10, 11 are constructed in accordance with examples of the present disclosure. As describe herein, the partial modular valve train assemblies 10, 11 utilize various combinations of modular features to provide various combinations of the following variable valve actuation (VVA) functions: cylinder deactivation (CDA), two or four-stroke decompression engine braking (EB), hydraulic lash adjustment (HLA), and intake or exhaust variable valve lift (VVL) including late intake valve closing (LIVC) and early exhaust valve opening (EEVO). Aspects can be combined on cylinders of a multi-cylinder engine to result in negative valve overlap (NVO), as by providing respective ones of the modular valve train assemblies 10, 11 on each side of the cylinder so that the intake side valves perform LIVC while the exhaust side valves perform EEVO. Other internal exhaust gas recirculation techniques (iEGR), including reinduction, can also be achieved by configuring for late exhaust valve closing (LEVC) or for re-opening the exhaust during the intake.

Each cylinder of a multi-cylinder engine can comprise the same modular valve train assembly 10, 11, or the cylinders can comprise different modular configurations of the modular valve train assemblies 10, 11. So, a first cylinder can comprise engine braking (EB) functionality, while another cylinder can comprise one of the LIVC, EEVO, NVO, iEGR, LEVC, etc. Further, when employing two added motion lifter assemblies 20 per pair of valves 42, 44 on a cylinder, it is possible that one of the valves perform a first VVA technique while the second one of the valves performs a different technique. For example, by employing a first added motion lifter 20, 21 for actuating valve 44, an engine braking function can be achieved, while a second added motion lifter 20, 21 for actuating valve 42 is configured for early exhaust valve opening (EEVO). The modular options afforded by the main lifter assemblies 18, 180, 181 permit selection for cylinder deactivation (CDA) functionality, so that one or more cylinders of a multi-cylinder engine can perform CDA alone or in combination with the other WA techniques. FIGS. 1A & 1B are illustrated having one added motion lifter assembly on one valve 44 while the second valve 42 follows a normal lift profile or is deactivated.

Figure 7:
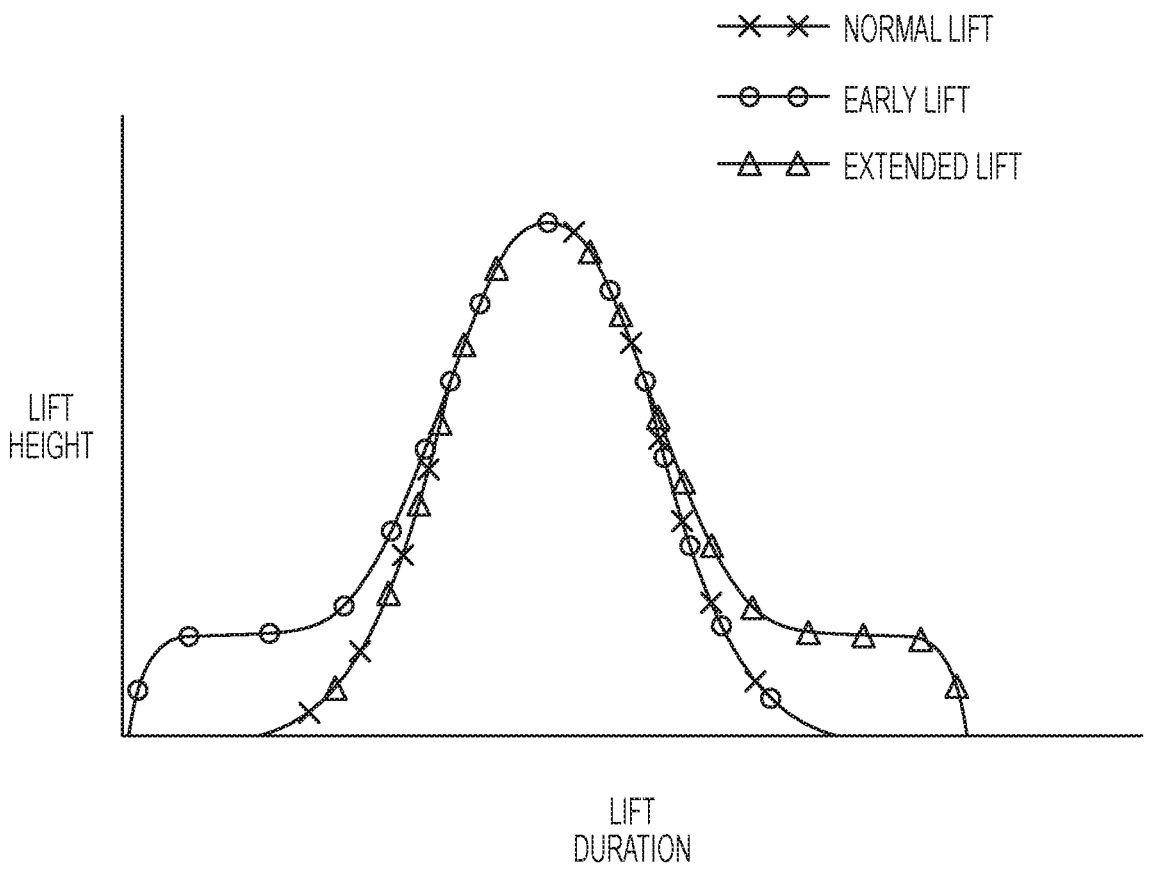
FIG. 7 includes explanatory lift profiles.

In an additional aspect, and in reference to FIG. 7, the modular valve train assemblies 10, 11 can be tailored as to lift height and lift duration. So, a normal lift profile for one of the exhaust or intake valves can comprise a particular lift height and lift duration. When engine braking in 2- or 4-stroke mode, the lift height of the exhaust valve can be shortened to a lower lift height. Additionally or alternatively, the exhaust valve could comprise an early lift profile and be opened earlier than the normal lift profile. Similar tailoring applies to early exhaust valve opening and early intake valve opening. The added motion lifter assembly 20, 21 can be tailored to provide a different lift height or different lift duration in the form of an extended lift profile to enable late exhaust valve closing or late intake valve closing. Another beneficial aspect of the combination of the main lifter assembly 18, 180, 181 with an added motion lifter assembly 20 is that the added motion lifter assembly 20, 21 can provide a first lift height for a valve for a first duration and then the main lifter assembly can further open the valve for another lift height at another lift duration. When using the deactivating main lifter assemblies 180, 181, the normal lift profile can be eliminated while providing an early or extended lift profile. The lower lift heights enabled by the added motion lifter assemblies 20, 21 reduces risk of critical shifts.

For purposes of explanation, the modular valve train assemblies 10, 11 are shown and described as configured for use on the exhaust side of a single cylinder of an engine. However, the intake side may be similarly configured for variable valve lift operations on an intake cylinder. It will be appreciated that the present disclosure can be used in any valve train assembly that utilizes the WA functions described herein. The teachings can be scaled according to engine size and cylinder configurations.

The modular valve train assembly system 10 is supported in a valve train carrier 12. Each cylinder can include an intake valve rocker arm assembly and an exhaust valve rocker assembly. The modular valve train assembly 10 is described for the exhaust valves, and comprises a dual valve rocker arm assembly 16, a main lifter assembly 18, and an added motion lifter assembly 20. The dual valve rocker arm assembly 16 includes a standard or second rocker arm assembly 30 and a first rocker arm assembly 32. The first and second rocker arm assemblies 32, 30 cooperate to control opening of the first and second exhaust valves 44, 42, and the intake valve rocker arm assembly is configured to control motion of the intake valves.

The second rocker arm assembly 30 is configured to control exhaust valve motion in a drive mode, and the first rocker arm assembly 32 is configured to act on one of the two exhaust valves to provide motion for features such as engine braking, LEVC, and EEVO, as will be described herein. When adapted for use on an intake valve side of a cylinder, LIVC and EIVO can be provided for. When modular valve train assembly system 10 is provided on both intake and exhaust sides of a cylinder, negative valve overlap (NVO) can be provided for.

A rocker shaft 36 is received by the valve train carrier 12 and supports rotation of the first and second rocker arm assemblies 32, 30. As described herein in more detail, the rocker shaft 36 can communicate oil to, among other things, rocker arm assemblies 30, 32, main lifter assembly 18, and added motion lifter assembly 20 during operation. A cam shaft 38 imparts lift profiles via cam lobes 40 to main lifter assembly 18, 180, 181 and added motion lifter assemblies 20, 21 so as to rotate rocker arm assemblies 32, 30 to activate first and second exhaust valves 44, 42, as is described herein in more detail.

Figure 4:
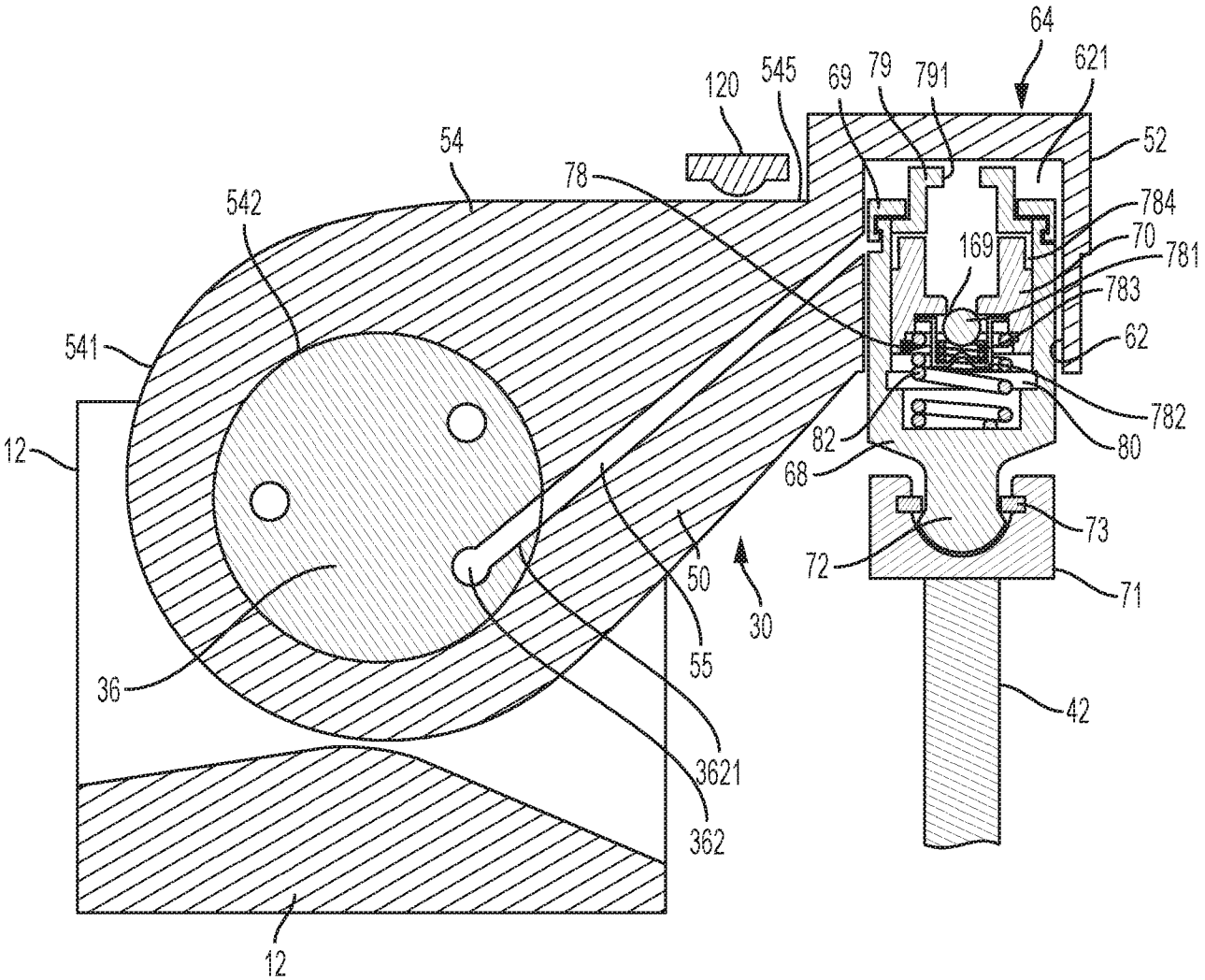

The second rocker arm assembly 30 in FIG. 4 can generally include an exhaust rocker arm 50, a lash assembly mount 52, and a rocker arm body 54. A wrapping portion 541 surrounds the rocker shaft 36 and comprises a rocker shaft bore 542 for receiving the rocker shaft 36. In one modular configuration, lash assembly mount 52 can be a hydraulic lash adjuster (HLA) assembly. In another modular configuration, lash assembly mount 52 can be a mechanical lash assembly (not shown). Thus, exhaust rocker arm 50 is configured to selectively receive either the HLA assembly or the mechanical lash assembly. Other capsules can be seated within the bore 62 based on application. The overhead location of the valve actuation arms 120 improves the ability to make modifications based on the intended implementation of the modular valve train assembly 10, such as valve stem length, lift heights, lift profiles, etc.

Rocker arm body 54 defines a bore 62 configured to at least partially receive the lash assembly 64. Lash assembly 64 is a hydraulic lash assembly (HLA), which is configured to take up any lash between the lash assembly 64 and the second exhaust valve 42. Exemplary lash assembly 64 can be substituted with other art-recognized devices. First plunger body 68 seats in bore 62 and receives second plunger body 70. A portion of first plunger body 68 protrudes from bore 62 to couple with second exhaust valve 42. Coupling can be achieved, for example, via a spigot 72 retained to an elephant foot (e-foot) 71 via a retainer clip 73. The elephant foot 71 pushes on the valve stem end to open and close the valve of a related cylinder. Second plunger body 70 is biased from first plunger body 68 via spring 82 and a first pressure chamber 80 is formed there between. Fluid admittance to first pressure chamber 80 is controlled, in part, via a check assembly 78 comprising a cage 782, a check spring 783, and a check member, such as a ball 781 or disc or other seal. Ball 781 is shown biased against shoulder 169 of second plunger body 70. Filling the first chamber 80 with a fluid in a known manner, as by moving the ball 781 or as by traversing one or more leak-down paths 784, permits the HLA assembly to take up lash in a known manner. For example, biasing mechanism (spring 82) biases second plunger body 70 upward to expand the first plunger body 66 to take up any lash. As second plunger body 70 is biased upward, oil is drawn through check assembly 78 and into the first pressure chamber 80 between plunger bodies 68, 70. Fluid can be supplied to a second pressure chamber 81 within second plunger body 70 through a shim port 791 in a shim 79 retained via a retainer 69 to first plunger body 68. Shim 79 helps to set a height, and can be omitted in some instances.

A fluid receptacle 621 can be formed in bore 62 so that fluid can be supplied to shim 79. A lash supply port 55 can be drilled through rocker arm body 54, between fluid receptacle 621 and rocker shaft bore 542. A lash pressure supply duct 362 down the center of the rocker shaft 36 can couple to lash supply port 55 via a lash supply coupling port 3621. A land can be formed in the rocker arm body 54 or in the rocker shaft 36, such as a step or scalloped edge or other fluid flow control shape.

Figure 3:
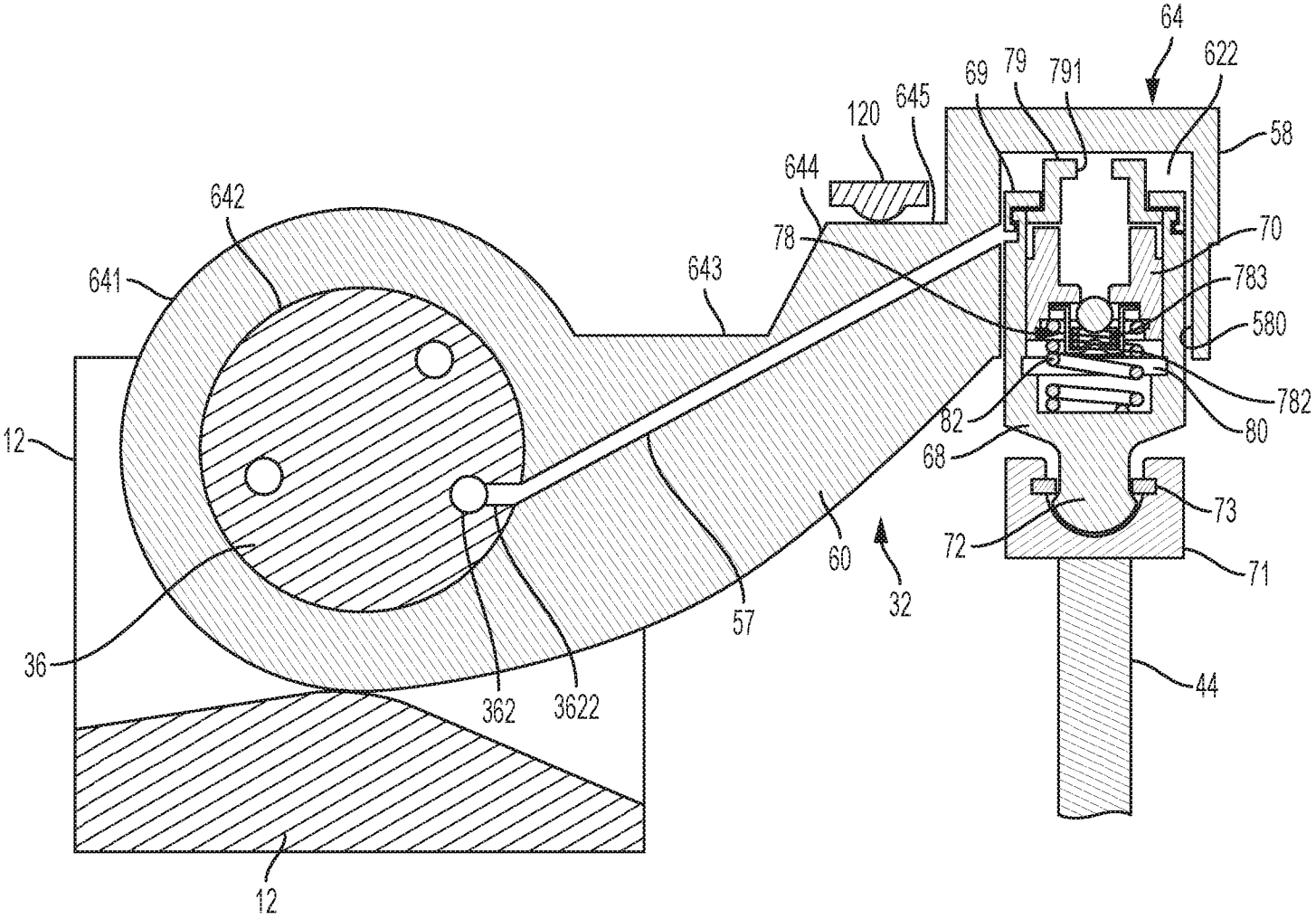
FIGS. 3 & 4 are views of exemplary rocker arm assemblies.
Figure 6A:
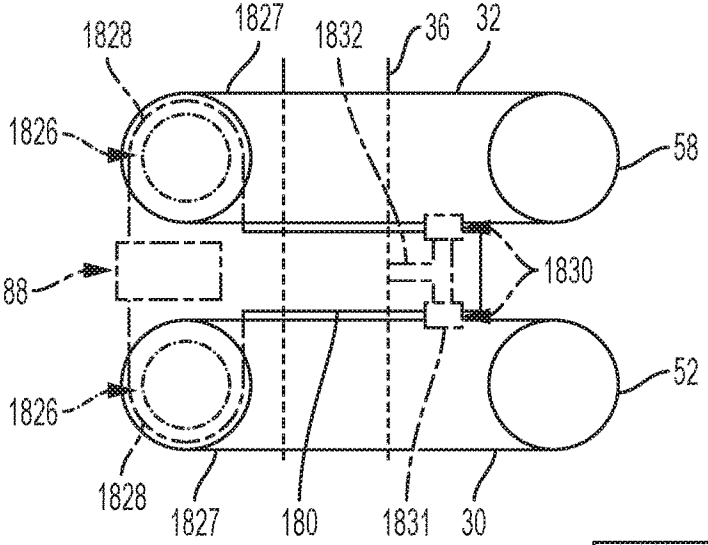
FIGS. 6A & 6B are views of another alternative main lifter assembly.
Figure 6B:
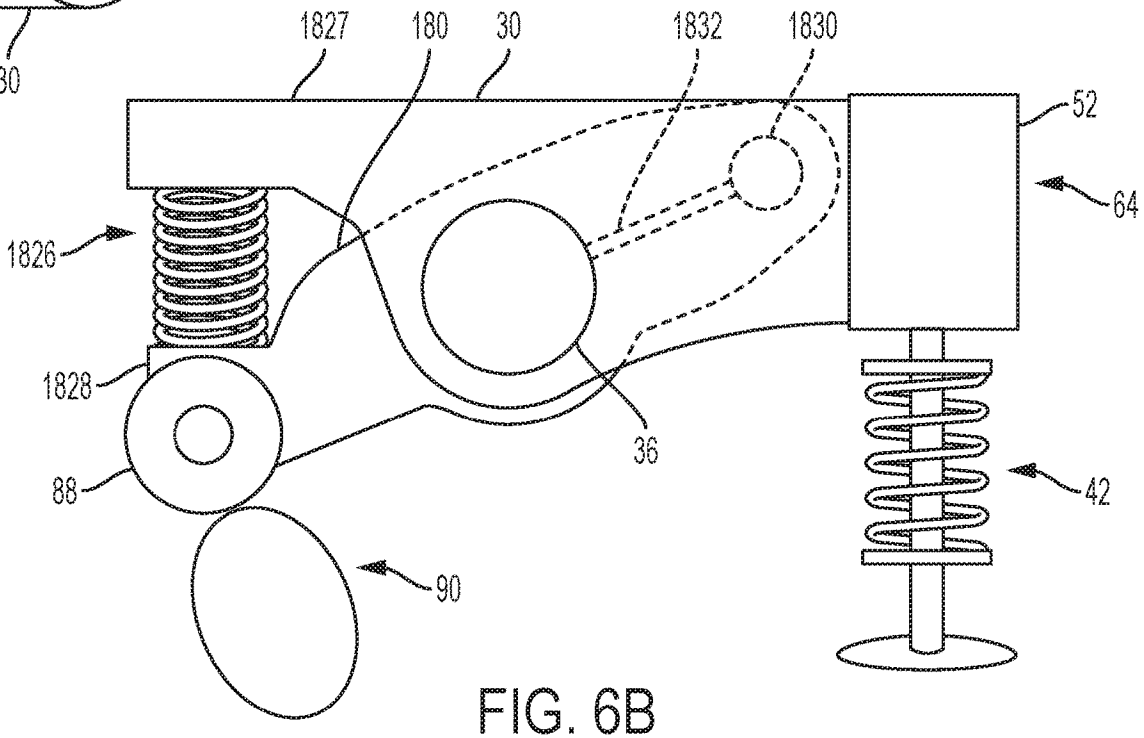

In FIG. 3, the second rocker arm assembly 30 is configured to be selectively moved downward by valve actuation arms 120 on main lifter assembly 18 to push first exhaust valve 44 downward into an open position. In FIGS. 6A & 6B, an alternative latch position eliminates the overhead valve actuation arms 120. Second rocker arm assembly 30 can be included with a cylinder that has two valves opening and closing the cylinder. It is possible to omit second rocker arm assembly 30 in circumstances applying a single first exhaust valve 44 to a cylinder and multiple lift profiles. Otherwise, second exhaust valve 42 is included.

First rocker arm assembly 32 is configured to provide regular opening and closing of first exhaust valve 44, and also added motion for an alternative lift profile, such as a lift profile shown in FIG. 7, via interfacing with added motion lifter assembly 20. So, first rocker arm assembly 32 can comprise a rocker arm body 60 and lash assembly mount 58. Modular and selectable lash capabilities lends first rocker arm assembly same or similar flexibility as second rocker art assembly 31. Many of the features of second rocker arm assembly 30 for providing lash take-up are included, but also modifications to interface with added motion lifter assembly 20. Overlapping aspects of lash control, such as hydraulic lash control via lash assembly 64 are incorporated from above. The same lash pressure supply duct 362 can be used with a corresponding lash supply coupling port 3622 to lash port 57. A similar fluid receptacle 622 can be included in a portion of a bore 580 within lash assembly mount 58.

Rocker arm body 60 can receive rocker shaft 36 in a rocker shaft bore 642 of a wrapping portion 641. The first rocker arm assembly 32 is configured to be selectively moved downward by actuation arm 120 of main lifter assembly 18 and/or added motion lifter assembly 20 to push first exhaust valve 44 downward into an open position. Actuation arm 120 pushes against an area, main lifter seat 645. The added motion lifter assembly 20 pushes against an area, added motion seat 643. The areas can be co-planar to resemble second rocker arm assembly 30. Or, as drawn, a transition area 644 can change the relative heights between the two areas so that added motion seat 643 is not co-planar with main lifter seat 645.

In FIGS. 1 & 3, main lifter assembly 18 comprises actuation arms 120 spanning from main lifter seat 645 on first rocker arm assembly 32 to a main lifter seat 545 on second rocker arm assembly 30. In FIGS. 6A & 6B, main lifter assembly 181 has an alternative configuration where latches extend in to pockets in the interior sides of first rocker arm assembly 32 and second rocker arm assembly 30.

The main lifter assembly 18 generally includes a lifter body 84, an axle 86, and a roller 88. Lifter body 84 can receive the rocker shaft 36, and axle 86 can be coupled to the lifter body 84 and can receive the roller 88, which is configured to be engaged by an exhaust lift profile on cam lobe 90 of the cam shaft 38. In one modular configuration, main lifter assembly 18 is a "fixed lifter" and is configured to cause downward movement of both first and second rocker arm assemblies 32, 30 when roller 88 is engaged by the exhaust lift profile on cam lobe 90, which engages the first and second exhaust valves 44, 42.

Figure 5:
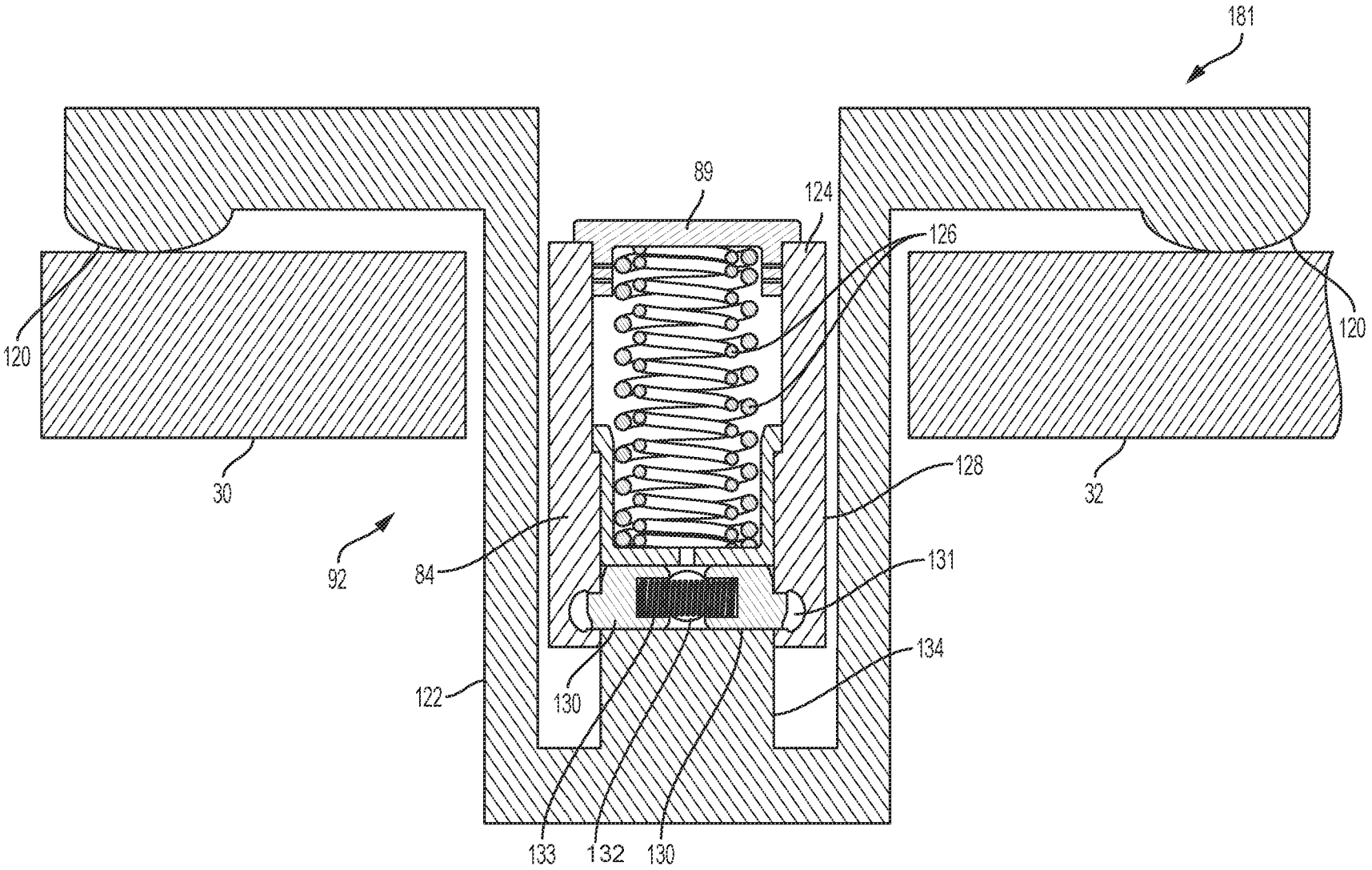
FIG. 5 is a view of an alternative main lifter assembly.

In another modular configuration of FIG. 5, the main lifter assembly 181 is a "deactivating lifter" configurable to enable cylinder deactivation (CDA). Deactivation main lifter assembly 181 includes a deactivation device 92 movable between an activated state (shown) and a deactivated state. FIGS. 1B and 5 illustrate one example implementation of deactivating device 92, which can generally include valve actuation arms 120 linked to an outer frame 122 and a deactivating projection 134. Lifter body 84 comprises inner arm portions 124 that extend between the outer frame 122. A deactivating capsule is formed between the inner arm portions 124. Lost motion springs 126 can be disposed within a carrier portion 128 of deactivating projection 134. A capsule cover 89 retains the lost motion springs 126 between inner arm portions 124. A latch bore can be drilled through the deactivating projection 134 to seat an adjacent a pair of latches 130 operated through an oil communication channel 132. A latch spring 133 pushes the latches 130 to seat in latch catches 131 in the inner arm portions 124 of lifter body 84. Oil to oil communication channel 132 can traverse to latch catches 131. Oil pressure can be controlled to actuate the latches 130. Alternatively, hydraulically actuated latches 130 can be replaced by mechanical latches such as a castellation latch or a rotary latch.

In the activated state (FIG. 5), valve actuation arms 120 of main lifter assembly 181 are configured to contact and cause downward movement of both first and second rocker arm assemblies 32, 30 when roller 88 is engaged by the cam lobe 90. This moves first and second exhaust valves 44, 42.

The deactivation device 92 can be moved to the deactivated state, for example, by supplying fluid through communication channel 132, thereby compressing latches 130. In the deactivated state, carrier 128 can slide between inner arm portions 124, and lost motion springs 126 can absorb lost motion, such that valve actuation arms 120 do not cause downward movement of first and second rocker arm assemblies 32, 30. When cam lobe 90 presses on roller 88, inner arm portions 124 rotate, but are decoupled from deactivating projection 134.

As such, in the activated state, when roller 88 is engaged by the exhaust lift profile of cam lobe 90, the deactivation main lifter assembly 181 is rotated downward, causing downward movement of the first and second rocker arm assemblies 32, 30, which engages the first and second exhaust valve 44, 42 associated with a cylinder of an engine. In the deactivated state, when roller 88 is engaged by the exhaust lift profile on cam lobe 90, the deactivation main lifter assembly 181 absorbs lost motion and does not impart downward movement on the first and second rocker arm assemblies 32, 30 and does not open first and second exhaust valves 44, 42.

In FIGS. 6A & 6B, the latches 1830 are moved to engage directly with the first and second rocker arm assemblies 32, 30, as by selectively protruding into catches 1831 in the sides of the first and second rocker arm assemblies. When the latches 1830 are engaged, first and second rocker arm assemblies 32, 30 move as in other embodiments to open and close first and second exhaust valves 44, 42. But, hydraulic fluid pressure controlled via rocker shaft 36 to latch port 1832 actuates the latches 1830 to retract. Then, when cam lobe 90 pushes on roller follower 88, the lost motion springs 1826 collapse between lost motion extensions 1827 on the first and second rocker arm assemblies 32, 30 and lost motion spring seats 1828 straddling the roller follower 88 on the main lifter assembly 180.

The main lifter assemblies 18, 180, 181 are configured to receive a normal lift profile from a normal lift cam lobe 90 and to rotate to impart the normal lift profile on both the first rocker arm assembly 32 and the second rocker arm assembly 30, unless the main lifter assemblies 180, 181 are in a deactivated (CDA) condition. The first and second rocker arm assemblies 32, 30 do not touch normal lift cam lobe 90, though they rock in response to the lift profile imparted thereby.

Figure 2A:
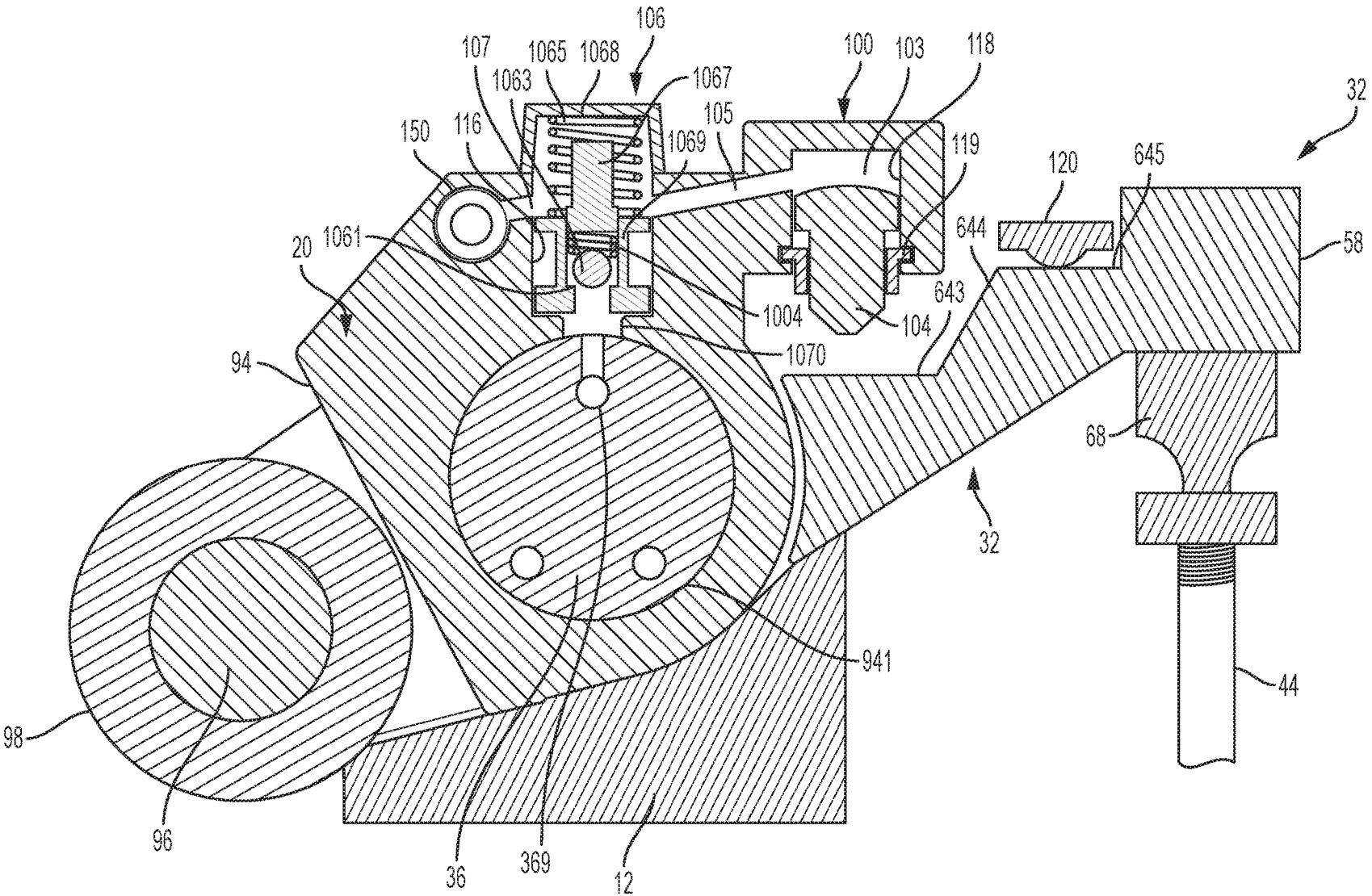
FIGS. 2A and 2B are views of alternative added motion lifter assemblies.
Figure 2B:
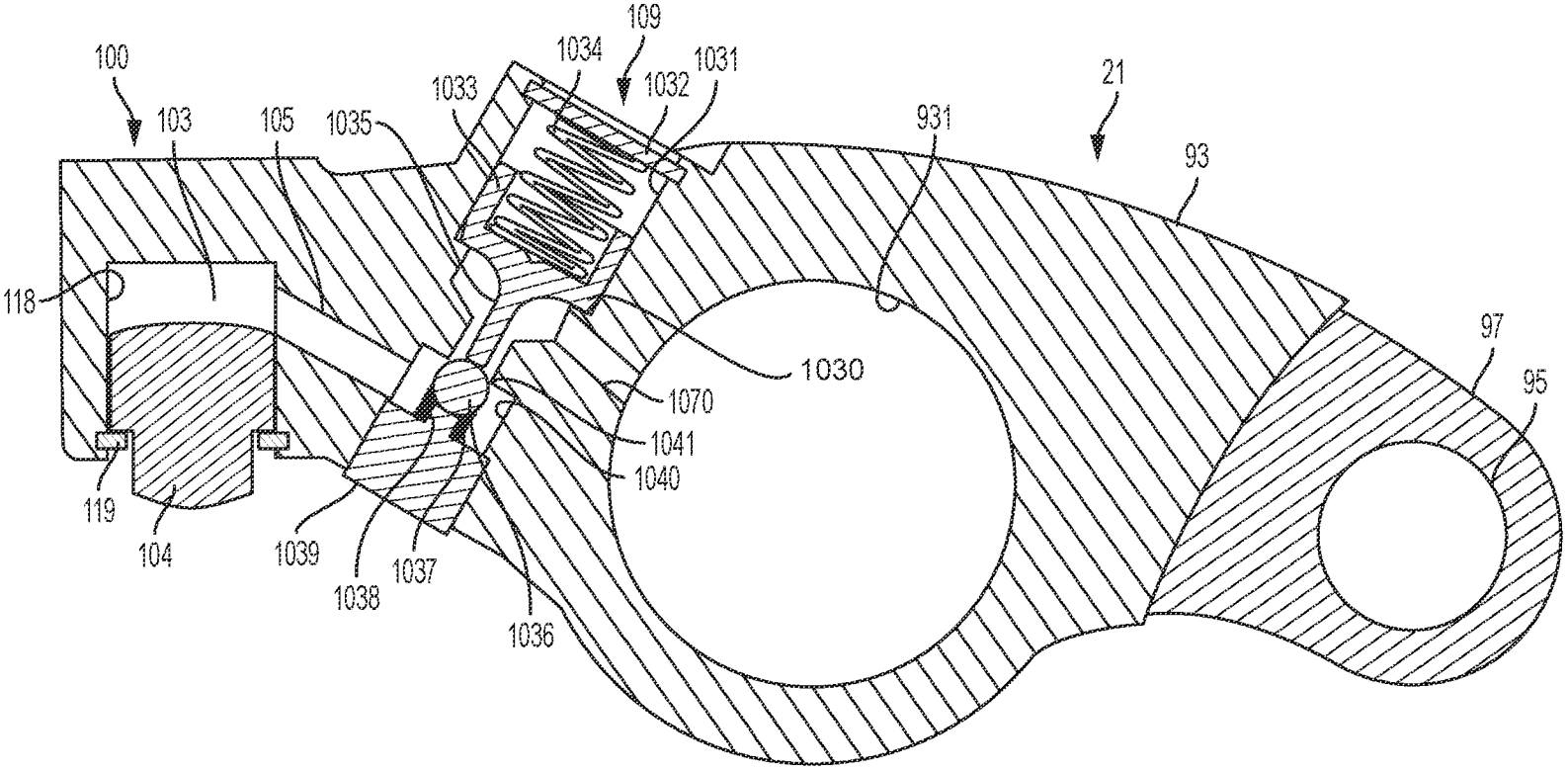

With reference now to FIGS. 1, 2A, and 2B, added motion lifter assembly 20 will be further described. Although a single added motion lifter assembly 20 is shown nested within the first rocker arm assembly 32, an additional added motion lifter assembly 20 can be operably associated with the second rocker arm assembly 30. The added motion lifter assembly 20 is configured to receive an added motion lift profile from an added motion cam lobe 102 and to rotate to impart the added motion lift profile on the first rocker arm assembly 32. The first rocker arm assembly 32 does not itself touch added motion cam lobe 102. The added motion lifter assembly 20 can generally include a body 94, an axle 96, a roller 98, and an actuator assembly 100. Body 94 can receive can receive the rocker shaft 36 in bore 941. Axle 96 can be coupled to the body 94 and can receive the roller 98, which is configured to be engaged by an exhaust lift profile or added motion cam lobe 102 of the cam shaft 38. Body 94 surrounds rocker shaft 36.

In the example of FIG. 2A, actuator assembly 100 includes a capsule or pin 104 that can be moved between the retracted position and the extended position in any suitable manner. But, in the example, the pin 104 is moved via hydraulic pressure control from rocker shaft 36 utilizing a pressurizable chamber 103 in bore 118 in fluid communication with a pin port 105, a valve 106, and lubrication oil from oil port 369 in rocker shaft 36. A seal is formed by a shoulder 1061 for selectively seating a check, or ball 1063. Oil or other hydraulic fluid passes the ball 1063 when the oil is of sufficient pressure to unseat the ball 1063 as shown and to overcome force of ball biasing spring 1004. Ball 1063 and spring 1004 can be retained via a spool such as slotted spacer 1069 braced against a prop 1067. Prop can alternatively be integrally formed with the slotted spacer 1069 to form a spool. A limiter can be included on the prop 1067 to limit the motion of the ball 1063. A cap 1068 biases a spring 1065 against the slotted spacer 1069 to bias the slotted spacer towards the rocker shaft 36.

In the illustrated position, fluid port 107 to anti-rotation latch 150 can fluidly communicate across bore 116 with pin port 105. Anti-rotation latch 150 can be controlled to hold the added motion lifter 20 away from the added motion cam lobe 102. Alternatively, a lost motion spring can be employed.

Fluid pressure can raise the slotted spacer 1069 and permit fluid communication from oil port 369 through a port 1070 to pin port 105, which can likewise impact fluid pressure to anti-rotation latch 150 for preparing the added motion lifter 20 for contact with cam lobe 102.

Valve 106 can be drop-in assembled in a valve bore 116 while pin 104 can be drop-in assembled in a pin bore 118. A frit, seal, clip or other retainer 119 can hold pin 104 in pin bore 118. However, the actuator assembly 100 may have any suitable structure and configuration that enables the actuator assembly to function as described herein.

In the retracted position, when roller 98 is engaged by the exhaust lift profile of the added motion cam lobe 102, the added motion lifter assembly 20 is rotated downward. However, because pin 104 is retracted, it does not contact the first rocker arm assembly 32, and thus does not impart downward movement thereon. Further, an anti-rotation latch 150 can be included to hold the added motion lifter assembly 20 out of contact with the cam lobe 102 supplying an exhaust lift profile 102. In the extended position, when roller 98 is engaged by the exhaust lift profile of the added motion cam lobe 102 and the added motion lifter assembly 20 is rotated downward, the pin 104 contacts the first rocker arm assembly 32. This causes the first rocker arm assembly 32 to push the first exhaust valve 44 downward into the open position. As such, depending on various lift profiles on the cam shaft 38, the added motion lifter assembly 20 can be utilized in the extended position to provide engine braking, LIVC, and/or EEVO. One of the lift profiles shown in FIG. 7 can be achieved, as by holding the first exhaust valve 44 open after the end of the normal lift profile or as by opening the first exhaust valve 44 prior to the start of the normal lift profile. When combined with the deactivating main lifter assemblies 181 or 180 of FIG. 5, 6A or 6B, cylinder deactivation can be achieved on the same valves capable of early or extended lift profiles.

In FIG. 2B, an alternative valve 109 for added motion lifter assembly 21 is shown. An extension 97 can receive axle 96 in bore 95. Body 93 further comprises a bore 931 for receiving rocker shaft 36. Needle mechanism 1030 in bore 1031 is capped by a seal or other retainer 1032. A spring 1034 is biased between the retainer 1032 and a spring cup 1033 to bias a needle 1035 against ball 1036 or other seal or check device. Ball 1036 abuts limiter 1038 on cap 1039 until a sufficient fluid pressure is supplied to bias spring cup 1033 towards retainer 1032. Ball spring 1037 can then push the ball 1036 against a shoulder 1041 restricting fluid communication between bore 1031 and bore 1040. When the added motion lifter assembly 21 rotates because of action imparted by added motion profile cam lobe 102, fluid cannot escape pressurizable chamber 103 due to the ball 1036 against shoulder 1041. The pin 104 pushes on first rocker arm assembly 32 for imparting the added motion. Retainer 1032 and cap 1039 can be threaded structures for setting the spring tensions of their respective springs 1034, 1037.

The added motion lifter assembly 21 is configured to receive an added motion lift profile from an added motion cam lobe 102 and impart the added motion lift profile on the first rocker arm assembly 32. The first rocker arm assembly 32 does not itself touch added motion cam lobe 102.

As described above, the modular valve train assembly system 10 includes modular components that can be included to provide desired VVA features. Specifically, rocker arm assemblies 30, 32, main lifter assembly 18, and added motion lifter assembly 20 are modular components that can be utilized (and in some cases modified) to form modular valve train assembly 10 to achieve the desired VVA features. In this way, modular valve train assembly 10 can provide cylinder deactivation (CDA) as a primary function and various other functions can be achieved by modular valve train assembly 10 through the addition and/or modification of the modular components. As such, modular valve train assembly 10 provides the ability to provide desired feature combinations with a standardized set of combinable modular components. Accordingly, hardware can be consistent across all applications, but desired features can be customized.

Various component combinations of the modular valve train assembly 10 result in variable valve actuation features achieved through the modular component combinations. For example, if it is desired for engine system to only have a hydraulic lash adjustment (HLA) feature, the modular valve train assembly 10 can be provided with a rocker arm having the HLA, and the fixed lifter. Similarly, if it is desired for the engine system to only have late intake valve closing (LIVC), modular valve train assembly 10 can be provided with a mechanically lashed rocker arm, a fixed lifter, and the added motion lifter assembly with added motion on the intake valve. If it is desired for the engine system to have two- or four-stroke engine braking, early exhaust valve opening (EEVO), and HLA features, modular valve train assembly 10 is provided with the rocker arm having the HLA, the deactivating lifter, and the added motion lifter assembly with added motion on exhaust and on intake. Various combinations of one or more of mechanical lash adjustment, HLA, CDA, engine braking, EEVO, LIVC, etc. can be achieved using one or more of the rocker arm assemblies 32, 20, main lifter assemblies 18, 180, 181, and added motion lifter assemblies 20, 21 described herein.

Described herein are systems and methods for a modular system that includes rocker arms with HLA (for actuating the valve), a deactivating lifter (for translating the primary cam lift events), and some combination of added motion lifters and additional control circuits to add additional VVA functions. As such, the modular system can be used to provide combinations of the following features: CDA, HLA, decompression engine braking (two and four-stroke), EEVO, LIVC.

Because the deactivating main lifter assembly 181 is not bound to the rocker arm assemblies 32, 30, the added motion lifter assemblies 20, 21 can be utilized to move one of the rocker arm assemblies independently of the other rocker arm assembly. The deactivating main lifter assembly 181 selectively pushes on the rocker arm assemblies 32, 30, but they are not fixed to the deactivating main lifter assembly 181, allowing the rocker arms to be pulled away if acted on by another force. Thus, the deactivating lifter can selectively push both rocker arm assemblies 32, 30 down for the main (normal) lift event when activated, yet absorb cam motion into lost motion when deactivated. The deactivating main lifter assembly 181 further provides a backstop for the rocker arm assemblies which helps reset the HLA assemblies 64.

As such, the modular system can include two rocker arm assemblies 32, 30 that may each include HLA or mechanical lash adjustment, a fixed lifter (no CDA) or deactivating lifter (CDA), and an added motion lifter assembly 20, 21 associated with either or both rocker arm assemblies. Various combinations of the modular components thus provide various combinations of features. Accordingly, the modular components can be combined to achieve the desired features of the modular system. This enables customization of the valve train assembly and provides the ability to adjust the assembly features at a future time to adapt to various vehicle engine requirements.

Other implementations will be apparent to those skilled in the art from consideration of the specification and practice of the examples disclosed herein.

What is claimed is:

1. A rocker arm assembly comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a normal lift profile to the first rocker arm assembly and to the second rocker arm assembly, wherein the main lifter assembly is configured as a deactivating lifter configured to selectively move between an activated state configured to cause downward movement of the first rocker arm assembly and of the second rocker arm assembly, and a deactivated state configured to absorb motion of a cam lobe into lost motion; and an added motion lifter assembly operably associated with the first rocker arm assembly and configured to selectively provide one of an early lift profile and an extended lift profile to the first rocker arm assembly.

2. The rocker arm assembly of claim 1, further comprising a rocker shaft connected to rotate within the first rocker arm assembly, the second rocker arm assembly, the main lifter assembly, and the added motion lifter assembly.

3. The rocker arm assembly of claim 1, wherein the main lifter assembly comprises at least one lost motion spring.

4. The rocker arm assembly of claim 1, wherein the main lifter assembly comprises hydraulic ports for supplying a hydraulic pressure to selectively move between the activated state and the deactivated state.

5. The rocker arm assembly of claim 1, wherein the added motion lifter assembly includes an actuator assembly configured to move between a retracted position and an extended position.

6. The rocker arm assembly of claim 5, comprising a rocker shaft supplying hydraulic pressure to the added motion lifter assembly, wherein the added motion lifter assembly comprises a hydraulically actuated pin configured to move between the retracted position and the extended position.

7. The rocker arm assembly of claim 1, wherein the main lifter assembly is configured to receive a normal lift profile from a normal lift cam lobe and to rotate to impart the normal lift profile on both the first rocker arm assembly and the second rocker arm assembly so that the first rocker arm assembly and the second rocker arm assembly rock in response to the received normal lift profile without touching the normal lift cam lobe.

8. The rocker arm assembly of claim 1, wherein the added motion lifter assembly is configured to provide at least one of an engine braking feature, a late intake valve closing feature, and an early exhaust valve opening feature.

9. The rocker arm assembly of claim 1, further comprising a second added motion lifter assembly operably associated with the second rocker arm assembly and configured to selectively provide one of an early lift profile and an extended lift profile.

10. A rocker arm assembly, comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a lift profile to the first rocker arm assembly and to the second rocker arm assembly; and an added motion lifter assembly operably associated with the first rocker arm assembly and configured to selectively provide one of an early lift profile and an extended lift profile to the first rocker arm assembly, wherein the main lifter assembly comprises a main lifter roller follower, wherein the added motion lifter assembly comprises an added motion lifter assembly roller follower, and wherein neither of the first rocker arm assembly and the second rocker arm assembly comprise a respective roller follower.

11. A rocker arm assembly, comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a lift profile to the first rocker arm assembly and to the second rocker arm assembly; and an added motion lifter assembly operably associated with the first rocker arm assembly and configured to selectively provide one of an early lift profile and an extended lift profile to the first rocker arm assembly, wherein the main lifter assembly is configured to be a fixed lifter configured to cause downward movement of the first rocker arm assembly and of the second rocker arm assembly when a normal profile cam lobe imparts a lift profile on the main lifter assembly.

12. A rocker arm assembly, comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a lift profile to the first rocker arm assembly and to the second rocker arm assembly, wherein the main lifter assembly comprises biased latches configured to selectively engage and disengage the first rocker arm assembly and the second rocker arm assembly; and an added motion lifter assembly operably associated with the first rocker arm assembly and configured to selectively provide one of an early lift profile and an extended lift profile to the first rocker arm assembly.

13. A rocker arm assembly, comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a lift profile to the first rocker arm assembly and to the second rocker arm assembly; and an added motion lifter assembly operably associated with the first rocker arm assembly and configured to selectively provide one of an early lift profile and an extended lift profile to the first rocker arm assembly, wherein the main lifter assembly comprises a rotatable body, a roller follower mounted to the rotatable body, and arms extending from the rotatable body, and wherein the arms extending from the rotatable body are configured to press against the first rocker arm assembly and the second rocker arm assembly when the rotatable body rotates in response to an imparted lift profile.

14. A rocker arm assembly, comprising:

a first rocker arm assembly configured to selectively receive one of a first hydraulic lash adjustment assembly or a first mechanical lash adjustment assembly;

a second rocker arm assembly configured to selectively receive a second hydraulic lash adjustment assembly or a second mechanical lash adjustment assembly;

a main lifter assembly operably associated with the first rocker arm assembly and with the second rocker arm assembly to impart a lift profile to the first rocker arm assembly and to the second rocker arm assembly; and an added motion lifter assembly operably associated with the first rocker arm assembly and configured to selectively provide one of an early lift profile and an extended lift profile to the first rocker arm assembly, wherein the added motion lifter assembly is nested in the first rocker arm assembly and is configured to receive an added motion lift profile from an added motion cam lobe and is configured to rotate to impart the added motion lift profile on the first rocker arm assembly.

* * * * *